US009222448B2

(12) United States Patent
Ghorpade et al.

(10) Patent No.: US 9,222,448 B2
(45) Date of Patent: Dec. 29, 2015

(54) AIR INTAKE SYSTEM FOR A WORK VEHICLE WITH IMPROVED FAN ASPIRATION

(71) Applicant: CNH Industrial America, LLC, New Holland, PA (US)

(72) Inventors: Kaushal Ghorpade, Bangalore (IN); Mihai Marinescu, North Aurora, IL (US); William Adamson, Naperville, IL (US); Eran Salzman, Thornhill (CA); Yingjie Tang, Willowbrook, IL (US)

(73) Assignee: CNH Industrial America LLC, New Holland, PA (US)

( * ) Notice: Subject to any disclaimer, the term of this patent is extended or adjusted under 35 U.S.C. 154(b) by 0 days.

(21) Appl. No.: 14/501,163

(22) Filed: Sep. 30, 2014

(65) Prior Publication Data

US 2015/0233328 A1 Aug. 20, 2015

Related U.S. Application Data

(60) Provisional application No. 61/939,849, filed on Feb. 14, 2014.

(51) Int. Cl.
*F02M 35/06* (2006.01)
*F02M 35/08* (2006.01)

(52) U.S. Cl.
CPC ..... *F02M 35/06* (2013.01); *F02M 35/086* (2013.01)

(58) Field of Classification Search
CPC ..... F02M 35/02; F02M 35/06; F02M 35/08; F02M 35/082; F02M 35/086; F02M 35/10
See application file for complete search history.

(56) References Cited

U.S. PATENT DOCUMENTS

| | | | | |
|---|---|---|---|---|
| 3,137,553 | A | 6/1964 | Billey | |
| 4,249,922 | A | 2/1981 | Saele | |
| 4,519,347 | A * | 5/1985 | Nolff | 123/195 A |
| 4,589,379 | A * | 5/1986 | Fujikawa et al. | 123/41.49 |
| 5,427,502 | A * | 6/1995 | Hudson | 415/211.1 |
| 6,202,777 | B1 | 3/2001 | Surridge | |
| 6,588,524 | B2 * | 7/2003 | Keen et al. | 180/69.2 |
| 6,780,215 | B2 | 8/2004 | Keen et al. | |
| 6,907,854 | B2 | 6/2005 | Wikner | |
| 6,966,293 | B1 * | 11/2005 | Patillo | 123/198 E |
| 6,976,825 | B2 * | 12/2005 | Wikner | 415/211.1 |
| 7,278,504 | B2 | 10/2007 | Smith et al. | |

(Continued)

OTHER PUBLICATIONS

Donaldson NPL-01 Pre-Cleaners p. 164 Air Cleaners (2 pages) Dated Nov. 12, 2014.

*Primary Examiner* — Jeffrey J Restifo
*Assistant Examiner* — Erez Gurari
(74) *Attorney, Agent, or Firm* — Sue C. Watson

(57) ABSTRACT

In one aspect, an air intake system for a work vehicle may generally include a fan shroud, a fan disposed within the fan shroud, an intake duct for receiving a portion of the air drawn through a front grille of the work vehicle by the fan and a filter assembly in flow communication with the intake duct. The filter assembly may include a pre-cleaner defining a scavenge port. The system may also include an aspiration conduit coupled to the scavenge port and an aspiration scoop extending between an inlet end and an outlet end. The inlet end may be coupled to the aspiration conduit. The aspiration scoop may extend through a portion of the fan shroud such that the outlet end is positioned within the fan shroud at a location upstream of the fan. The outlet end may include an outlet opening defined by at least one curved wall.

20 Claims, 10 Drawing Sheets

(56) References Cited

U.S. PATENT DOCUMENTS

| | | | | |
|---|---|---|---|---|
| 8,167,067 | B2 | 5/2012 | Peterson et al. | |
| 8,256,551 | B2 * | 9/2012 | Entriken et al. | 180/68.1 |
| 8,641,792 | B2 * | 2/2014 | Vladaj et al. | 55/385.3 |
| 2005/0066931 | A1 * | 3/2005 | Wikner | 123/198 E |
| 2008/0086989 | A1 * | 4/2008 | Sheidler | 55/345 |
| 2008/0178592 | A1 | 7/2008 | Bering | |
| 2009/0084344 | A1 * | 4/2009 | Fasan | 123/198 E |
| 2009/0283079 | A1 * | 11/2009 | Tsunoda | 123/65 PD |
| 2010/0071978 | A1 * | 3/2010 | Kisse | 180/68.2 |
| 2012/0036843 | A1 | 2/2012 | Schertz et al. | |
| 2012/0152200 | A1 * | 6/2012 | Schlesinger et al. | 123/198 E |
| 2013/0025557 | A1 * | 1/2013 | Chlystek et al. | 123/184.21 |
| 2014/0182956 | A1 * | 7/2014 | Morey et al. | 180/68.1 |
| 2015/0027311 | A1 * | 1/2015 | Link et al. | 95/279 |

* cited by examiner

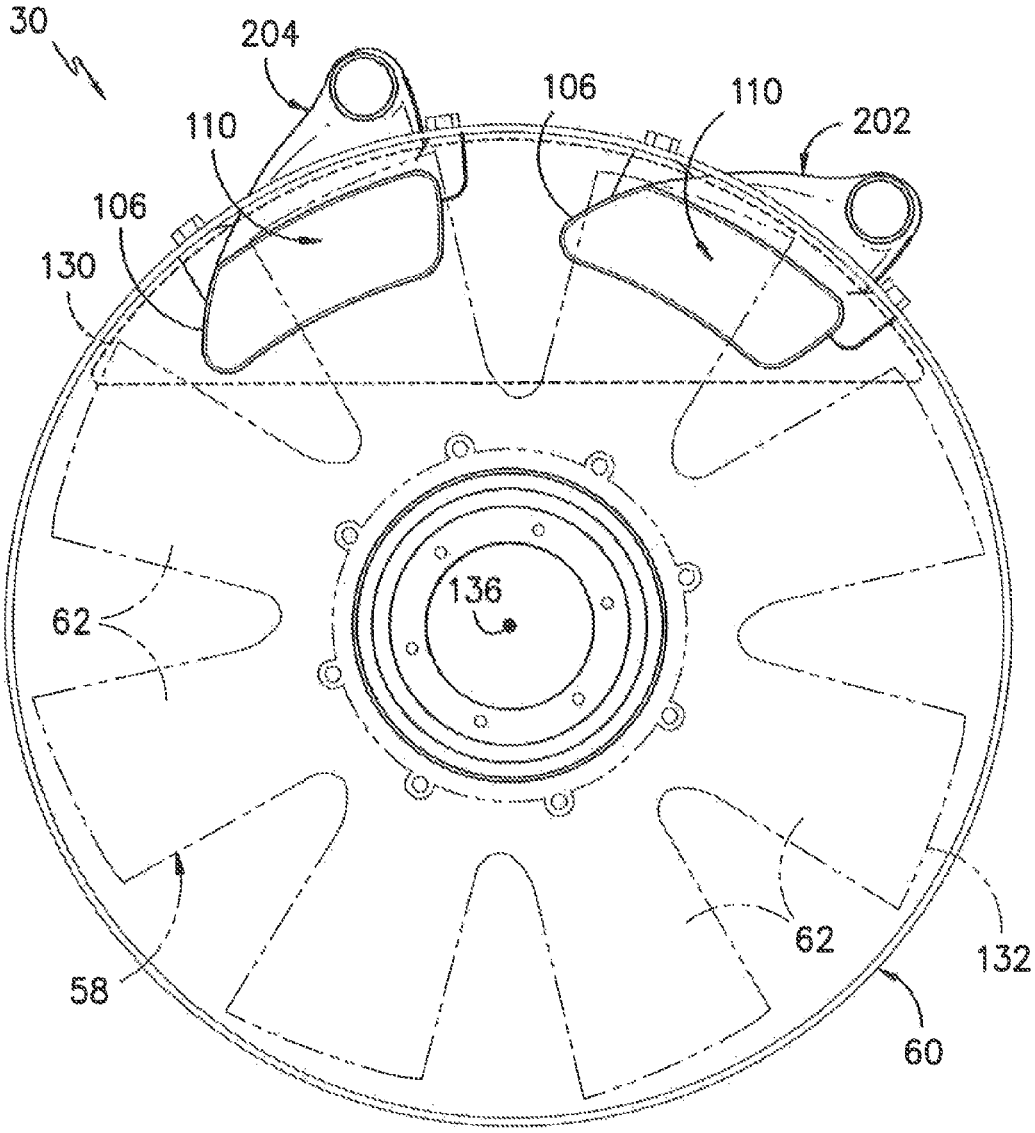
FIG. —10—

AIR INTAKE SYSTEM FOR A WORK VEHICLE WITH IMPROVED FAN ASPIRATION

FIELD OF THE INVENTION

The present subject matter relates generally to work vehicles and, more particularly, to an air intake system for a work vehicle with improved fan aspiration.

BACKGROUND OF THE INVENTION

Work vehicles typically include internal combustion engines that require clean air for use within the combustion process. Since many work vehicles, such as tractors and other agricultural vehicles, operate in fields and other harvesting environments in which the ambient air contains large amounts of dust, plant material and other particulates, an air intake system having an effective filter assembly is required. For example, conventional filter assemblies for work vehicles typically include a vortex or cyclone pre-cleaner configured to separate large particulates from the intake air and a porous air filter downstream of the pre-cleaner to provide the final stage of filtering prior to delivering the air into the engine.

To prevent the air filter from clogging, the large particulates separated from the intake air by the pre-cleaner must be removed from the filter assembly. Typically, such particulates are removed from the filter assembly via an outlet port defined in a housing of the filter assembly using a vacuum generated by the exhaust flow from the engine. However, the vacuum generated by the exhaust flow is often insufficient to meet the performance requirements of the filter assembly, thereby causing the air filter to plug within a short period of time. In addition, exhaust-driven aspiration typically creates a flow restriction within the exhaust flow and also leads to an increase in the noise generated by the vehicle. Such aspiration systems also typically require a check valve to prevent a backflow of exhaust gases into the pre-cleaner.

To avoid such issues, fan-driven aspiration systems have been developed that utilize a vacuum generated by the vehicle's cooling fan to remove particulates from the pre-cleaner. However, current fan driven aspiration systems still suffer from many drawbacks. For example, due to the placement and/or configuration of the existing components provided within current fan-driven aspiration systems, the vacuum generated is typically less than optimal. In addition, particulates often become stuck within the tubing extending between the pre-cleaner and the location of the fan.

Accordingly, an air intake system for a work vehicle having improved fan aspiration would be welcomed in the technology.

BRIEF DESCRIPTION OF THE INVENTION

Aspects and advantages of the invention will be set forth in part in the following description, or may be obvious from the description, or may be learned through practice of the invention.

In one aspect, the present subject matter is directed to an air intake system for a work vehicle. The air intake system may generally include a fan shroud extending between a shroud inlet and a shroud outlet and a fan disposed within the fan shroud. The fan may be configured to draw air through a front grille of the work vehicle. The air intake system may also include an intake duct for receiving a portion of the air drawn through the front grille and a filter assembly in flow communication with the intake duct. The filter assembly may include a pre-cleaner and an air filter. The pre-cleaner may define a scavenge port. Additionally, the air intake system may include an aspiration conduit coupled to the scavenge port and an aspiration scoop extending between an inlet end and an outlet end. The inlet end may be coupled to the aspiration conduit. The aspiration scoop may extend through a portion of the fan shroud between the inlet and outlet ends such that the outlet end is positioned within the fan shroud at a location upstream of the fan. The outlet end may include an outlet opening facing towards the fan. The outlet opening may be defined by at least one curved wall. Moreover, rotation of the fan may generate a vacuum within the aspiration scoop such that particulates within the pre-cleaner are directed through the aspiration conduit and are expelled from the outlet opening of the aspiration scoop.

In another aspect, the present subject matter is directed to an air intake system for a work vehicle. The air intake system may generally include a fan shroud extending between a shroud inlet and a shroud outlet and a fan disposed within the fan shroud. The fan may be configured to draw air through a front grille of the work vehicle. The air intake system may also include an intake duct for receiving a portion of the air drawn through the front grille and a filter assembly in flow communication with the intake duct. The filter assembly may include a pre-cleaner and an air filter. The pre-cleaner may define a scavenge port. Additionally, the air intake system may include an aspiration conduit extending axially between a first end and a second end. The first end may be coupled to the scavenge port. The aspiration conduit may be continuously downwardly sloped between the first end and the second end. The air intake system may also include an aspiration scoop extending between an inlet end and an outlet end. The inlet end may be coupled to the second end of the aspiration conduit. The aspiration scoop may extend through a portion of the fan shroud between the inlet and outlet ends such that the outlet end is positioned within the fan shroud at a location upstream of the fan. The outlet end may include an outlet opening facing towards the fan. Moreover, rotation of the fan may generate a vacuum within the aspiration scoop such that particulates within the pre-cleaner are directed through the aspiration conduit and are expelled from the outlet opening of the aspiration scoop.

In a further aspect, the present subject matter is directed to an air intake system for a work vehicle. The air intake system may generally include a fan shroud extending between a shroud inlet and a shroud outlet and a fan disposed within the fan shroud. The fan may be configured to draw air through a front grille of the work vehicle. The air intake system may also include an intake duct for receiving a portion of the air drawn through the front grille and a filter assembly in flow communication with the intake duct. The filter assembly may include a pre-cleaner and an air filter. The pre-cleaner may define a scavenge port. Additionally, the air intake system may include an aspiration conduit coupled to the scavenge port and first and second aspiration scoops extending between an inlet end and an outlet end. The inlet end of each scoop may be coupled to the aspiration conduit. Each aspiration scoop may also extend through a portion of the fan shroud between its inlet and outlet ends such that the outlet end is positioned within the fan shroud at a location upstream of the fan. The outlet end of each aspiration scoop may include an outlet opening facing towards the fan. Moreover, rotation of the fan may generate a vacuum within the aspiration scoops such that particulates within the pre-cleaner are directed through the aspiration conduit and are expelled from the outlet opening of each aspiration scoop.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIG. 10 illustrates a rear view of a fan and the firs and second aspiration scoops of the air intake system from a perspective of line 10-10 shown in FIG. 9, particularly illustrating the relative positioning of the fan and the aspiration scoops within a fan shroud of the air intake system.

DETAILED DESCRIPTION OF THE INVENTION

Figure 1:
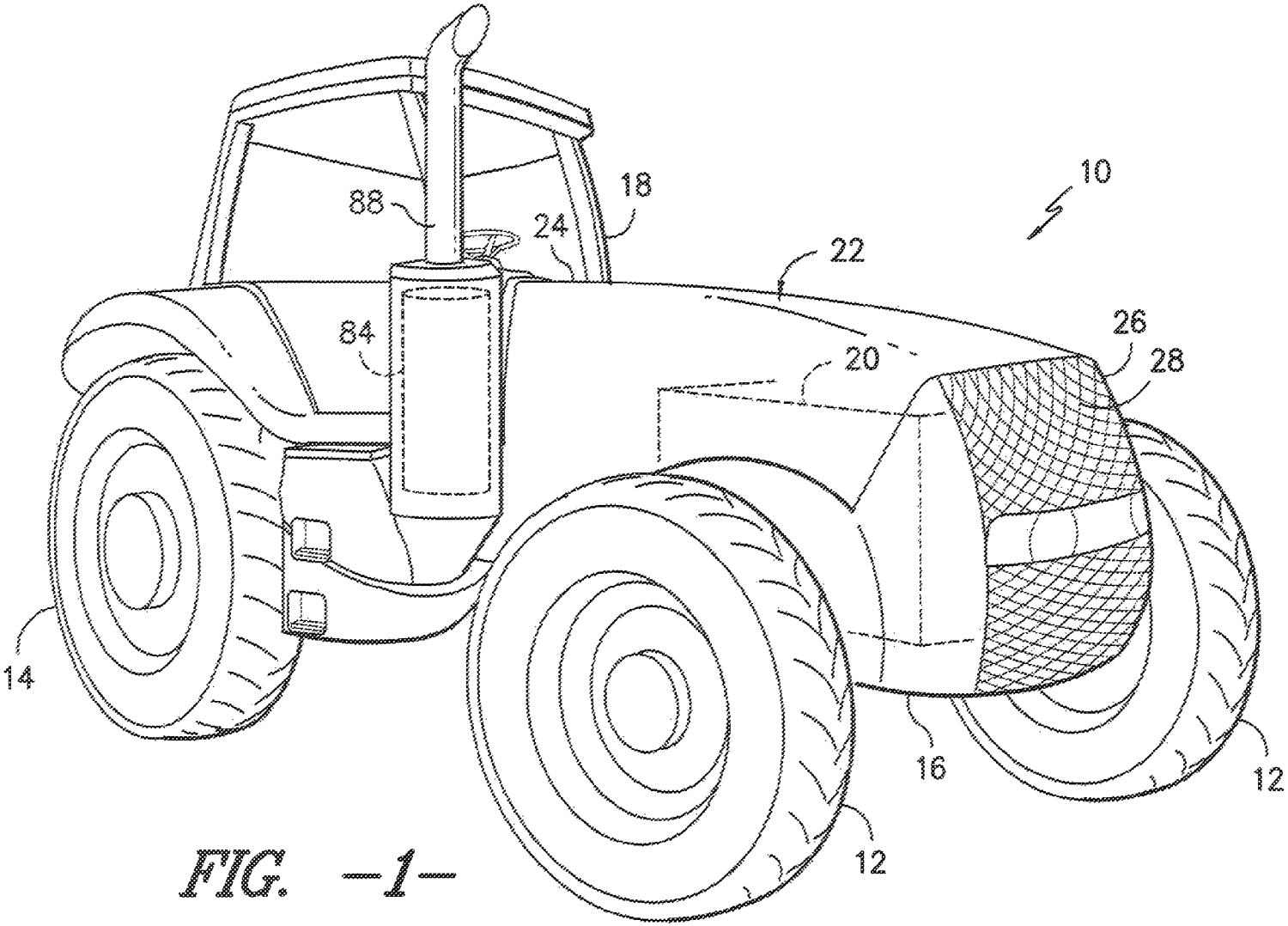
FIG. 1 illustrates a perspective view of one embodiment of a work vehicle.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Referring now to the drawings, FIG. 1 illustrates a perspective view of one embodiment of a work vehicle 10. As shown, the work vehicle 10 is configured as an agricultural tractor. However, in other embodiments, the work vehicle 10 may be configured as any other suitable work vehicle known in the art, such as various other agricultural vehicles (e.g., combines), earth-moving vehicles, road vehicles, loaders and/or the like.

As shown in FIG. 1, the work vehicle 10 includes a pair of front wheels 12, a pair or rear wheels 14 and a chassis 16 coupled to and supported by the wheels 12, 14. An operator's cab 18 may be supported by a portion of the chassis 16 and may house various control devices (not shown) for permitting an operator to control the operation of the work vehicle 10. Additionally, the work vehicle 10 may include an engine 20 and a transmission (not shown) mounted on the chassis 16. The transmission may be operably coupled to the engine 20 and may provide variably adjusted gear ratios for transferring engine power to the wheels 14 via a differential (not shown).

Additionally, the work vehicle 10 may also include a hood 22 configured to extend between an aft end 24 disposed adjacent to the cab 18 and a forward end 26 defining a grille 28 at the front of the work vehicle 10. As is generally understood, the hood 22 may be configured to least partially surround and/or cover various under-hood components of the wok vehicle 10, such as the engine 20 and any other suitable under-hood components (e.g., hydraulic components, pneumatic components, electrical components, mechanical component(s), storage tank(s), etc.). As will be described below, various components of an air intake system 30 and an exhaust cleaning system 32 of the work vehicle 10 may also be housed within, installed underneath and/or otherwise positioned vertically below the hood 22.

Figure 2:
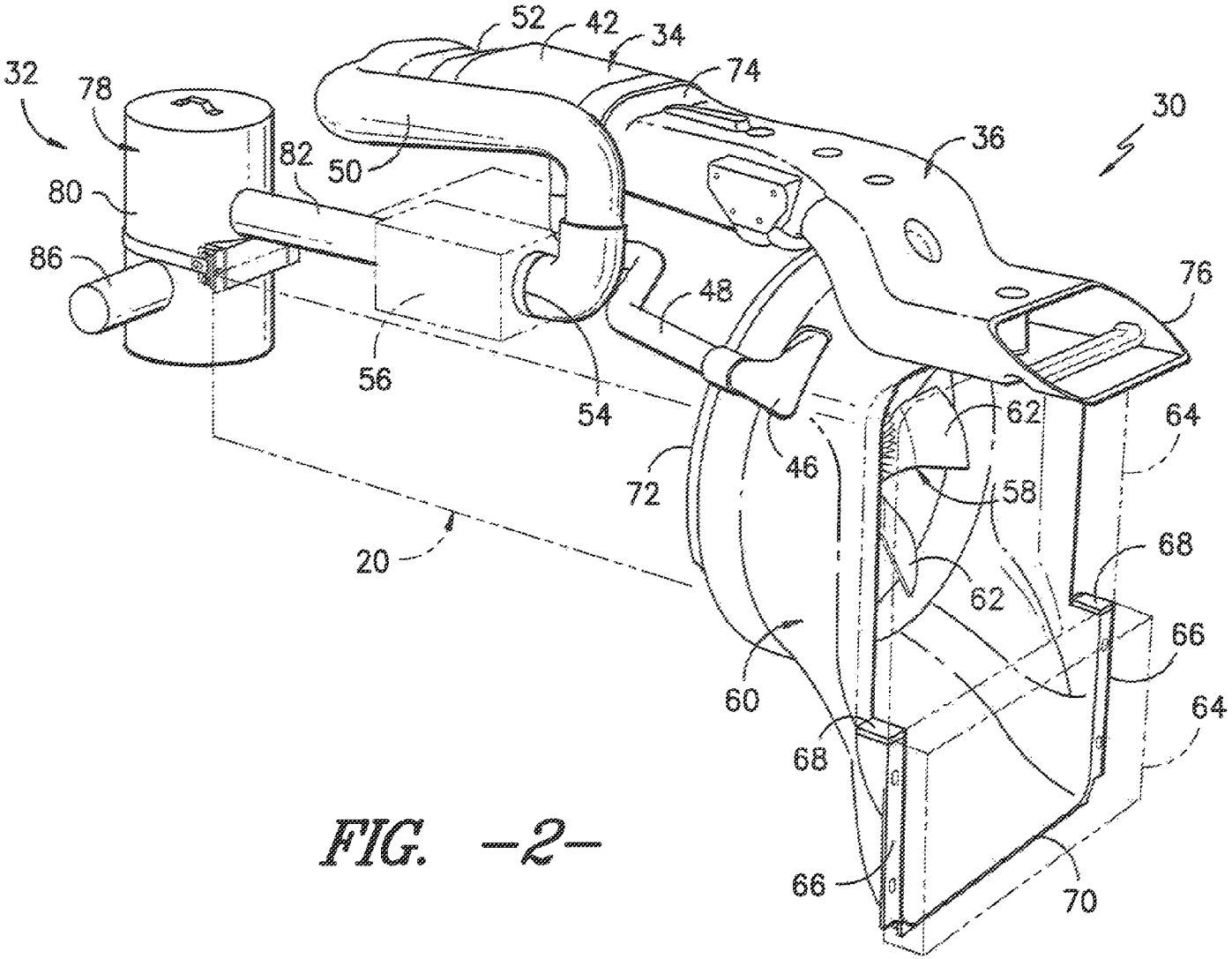
FIG. 2 illustrates a front perspective view of various components of an air intake system and an exhaust treatment system suitable for use with the work vehicle shown in FIG. 1.
Figure 3:
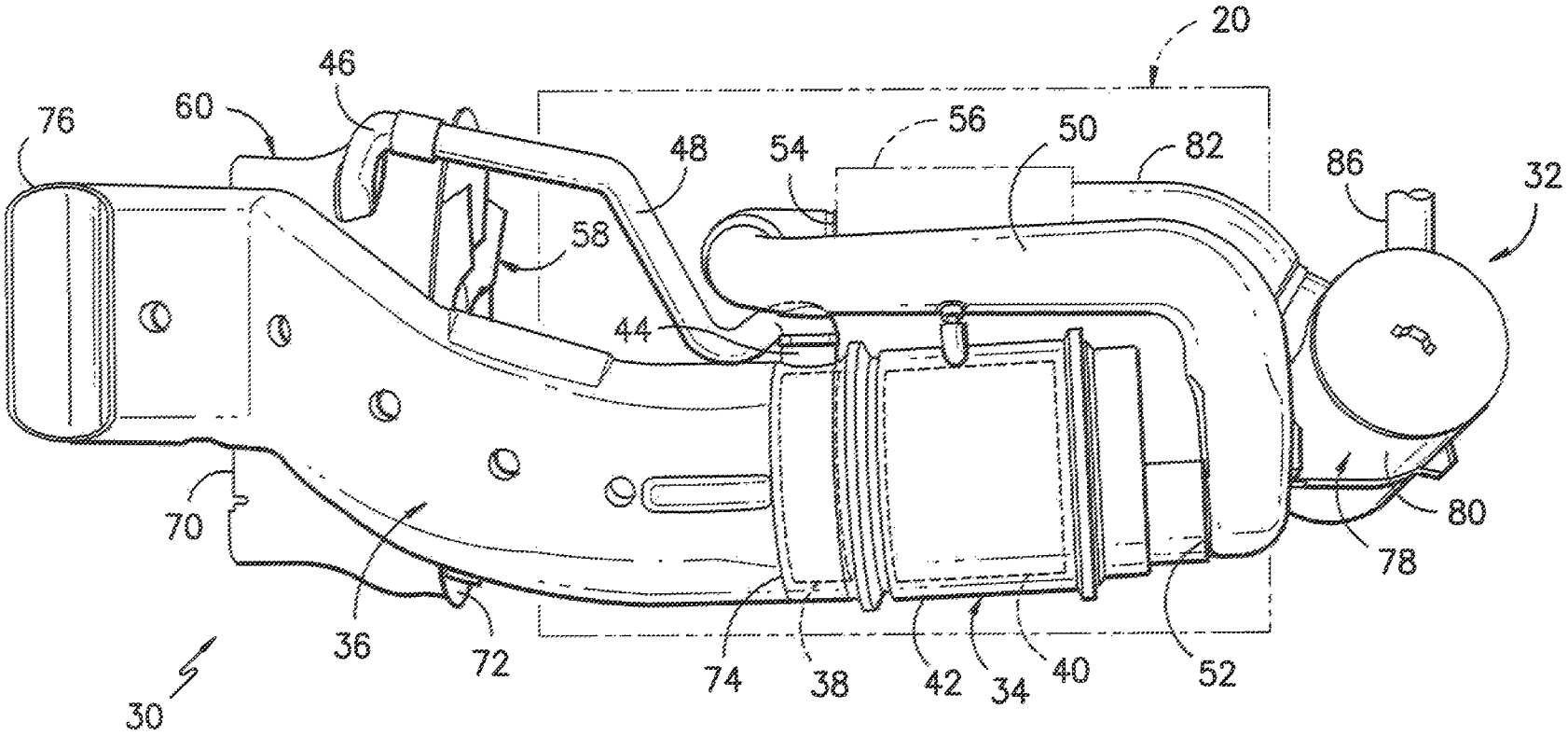
FIG. 3 illustrates a top view of the components shown in FIG. 2.

Referring now to FIGS. 2 and 3, differing views of at least a portion of an air intake system 30 and an exhaust cleaning system 32 suitable for use with the work vehicle 10 shown in FIG. 1 are illustrated in accordance with aspects of the present subject matter. Specifically, FIG. 2 illustrates a perspective view of various components of the air intake and exhaust cleaning systems 30, 32. Additionally, FIG. 3 illustrates a top view of the components shown in FIG. 2.

As shown, the air intake system 30 may generally include a filter assembly 34 configured to receive dirty air from an intake duct 36 and clean/filter such air for subsequent delivery to the engine 20 (shown in phantom lines). In general, the filter assembly 34 may include a pre-cleaner (indicated by dashed box 38 in FIG. 3) and an air filter (indicated by dashed box 40 in FIG. 3) disposed downstream of the pre-cleaner 38. In addition, the filter assembly may include a housing 42 configured to house or otherwise encase the pre-cleaner 38 and the air filter 40.

As is generally understood, the pre-cleaner 38 may be configured to remove portions of the dust, dirt, debris, plant matter and other particulates contained within the air flowing into the filter assembly 34 via the intake duct 36. Specifically, in several embodiments, the pre-cleaner 38 may include one or more tubes (e.g., turbo tubes), dirt separators, and/or any other suitable pre-cleaner elements (not shown) configured to separate large particulates from the air via centripetal force. For example, the pre-cleaner element(s) may be configured to impart a vortex or spinning motion to the flow of air entering the filter assembly 34. As a result, the large particulates contained within the air may be forced radially outwardly along the inner wall of the housing 42 by the centripetal force of the vortex/spinning motion. Such particulates may then be expelled from the filter assembly 34 via a scavenge port 44 (FIG. 3) defined through the housing 42 along the outer perimeter of the pre-cleaner 38. For example, as will be described in detail below, an aspiration scoop(s) 46 may be in flow communication with the scavenge port 44 via an aspiration conduit 48 to allow large particulates to be removed from the pre-cleaner 38.

Additionally, the air filter 40 may generally be configured to receive the cleaned air flowing from the pre-cleaner 38 and filter such air to provide a final stage of filtering prior to delivery of the air to the engine 20. Thus, the air filter 40 may generally include one or more filter elements (not shown) configured to catch or trap the remaining particulates contained within the cleaned air. For instance, in several embodiments, the filter element(s) may be made from a fibrous, porous or mesh material that allows air to pass therethrough while catching/trapping any particulates. The cleaned/filtered air may then be directed through a suitable output conduit 50 to the engine 20, where the air may be mixed with fuel and combusted. For instance, as shown in FIGS. 2 and 3, the output conduit 50 may extend from an output end 52 of the filter assembly 34 to an intake end 54 of a turbocharger 56 of the engine 20.

As shown in the illustrated embodiment, the air intake system 30 may also include a fan 58 and a fan shroud 60 configured to encase or otherwise surround the fan 58. In general, the fan 58 may include a plurality of fan blades 62 configured to be rotated so as to draw air through the front grille 28 (FIG. 1) of the work vehicle 10, thereby providing an airflow across one or more heat exchangers 64 (shown in phantom lines) positioned between the fan 58 and the front grille 28. For example, as shown in FIG. 2, heat exchangers 64 may be mounted to and/or otherwise supported by the fan shroud 60 at a location upstream of the fan 58 via suitable mounting flanges 66 and/or support pads 68 positioned at the front of the shroud 60. Thus, as air is drawn through the front grille 28 and is directed towards the fan 58, at least a portion of the air may pass through the upstream heat exchanger(s) 64.

It should be appreciated that the fan 58 may be configured to be rotatably driven using any suitable drive means known in the art. For instance, in one embodiment, the fan 58 may be coupled to an output shaft (not shown) of the engine 20. In another embodiment, the fan 58 may be rotatably driven by any other suitable drive means, such as by using a separate drive motor rotatably coupled to the fan 58.

It should also be appreciated that the fan shroud 60 may generally be configured to define a passageway for the air drawn through the heat exchanger(s) 64 by the fan 58. For example, as shown in the illustrated embodiment, the fan shroud 60 may define a shroud inlet 70 disposed adjacent to the heat exchanger(s) 64 and a shroud outlet 72 disposed aft of the fan 58. As such, the air passing through the heat exchanger(s) 64 may be received by the shroud inlet 70 and expelled from the fan shroud 60 via the shroud outlet 72. Additionally, as particularly shown in FIG. 2, the fan shroud 60 may, in one embodiment, be configured to transition from a generally rectangular shape at the shroud inlet 70 to a generally circular shape at the shroud outlet 72. As such, the rectangular opening defined by the shroud inlet 70 may be configured to capture the air flowing through the generally rectangular-shaped heat exchanger(s) 64 while the circular portion of the fan shroud 60 extending towards the shroud outlet 72 may be configured to encase or surround the fan blades 62. However, it should be appreciated that, in alternative embodiments, the fan shroud 60 may have any other suitable configuration/shape that permits it to function as described herein.

As shown in FIGS. 2 and 3, in several embodiments, a portion of the intake duct 36 may be configured to extend directly above the fan shroud 60. For example, the intake duct 36 may generally extend between a first end 74 in flow communication with the pre-cleaner 38 and an open second end 76 positioned directly upstream of the shroud inlet 70. As particularly shown in FIG. 2, the second end 76 of the intake duct 36 may generally define an elongated opening to allow air to be captured by the intake duct 36 as it flows through the front grille 28.

Referring still to FIGS. 2 and 3, the exhaust treatment system 32 of the work vehicle 10 may generally include a diesel oxidation catalyst (DOC) system 78 and a selective catalytic reduction (SCR) system 84 (FIG. 1). As is generally understood, the DOC system 78 may include a DOC housing 80 configured to house one or more catalysts (not shown) that serve to oxidize carbon monoxide and unburnt hydrocarbons contained within engine exhaust received from the vehicle's engine 20. For instance, as shown in FIGS. 2 and 3, a suitable exhaust conduit 82 may be coupled between the engine 20 and the DOC housing 80 to allow engine exhaust to be directed into the DOC system 78. In addition, a mixing chamber (not shown) may be defined within the DOC housing 80 to allow the engine exhaust to be mixed with at least one reductant, such as a diesel exhaust fluid (DEF) reductant or any other suitable urea-based reductant, supplied into the housing 80.

The SCR system 84 may generally be in flow communication with the DOC system 78 to allow the exhaust/reductant mixture expelled from the DOC system 78 to be supplied to the SCR system 84. For example, as shown in FIGS. 2 and 3, a conduit 86 (only a portion of which is shown) may be configured to extend between the DOC system 78 and the SCR system 84 for supplying the exhaust/reductant mixture to the SCR system 84. As is generally understood, the SCR system 84 may be configured to reduce the amount of nitrous oxide (NOx) emissions contained within the flow of engine exhaust using a suitable catalyst (not shown) that reacts with the reductant to convert the NOx emissions into nitrogen, water and carbon dioxide (CO2). The cleaned exhaust flow may then be discharged from the SCR system 84 and expelled into the surrounding environment (e.g., via an exhaust pipe 88 (FIG. 1) of the work vehicle 10).

Figure 4:
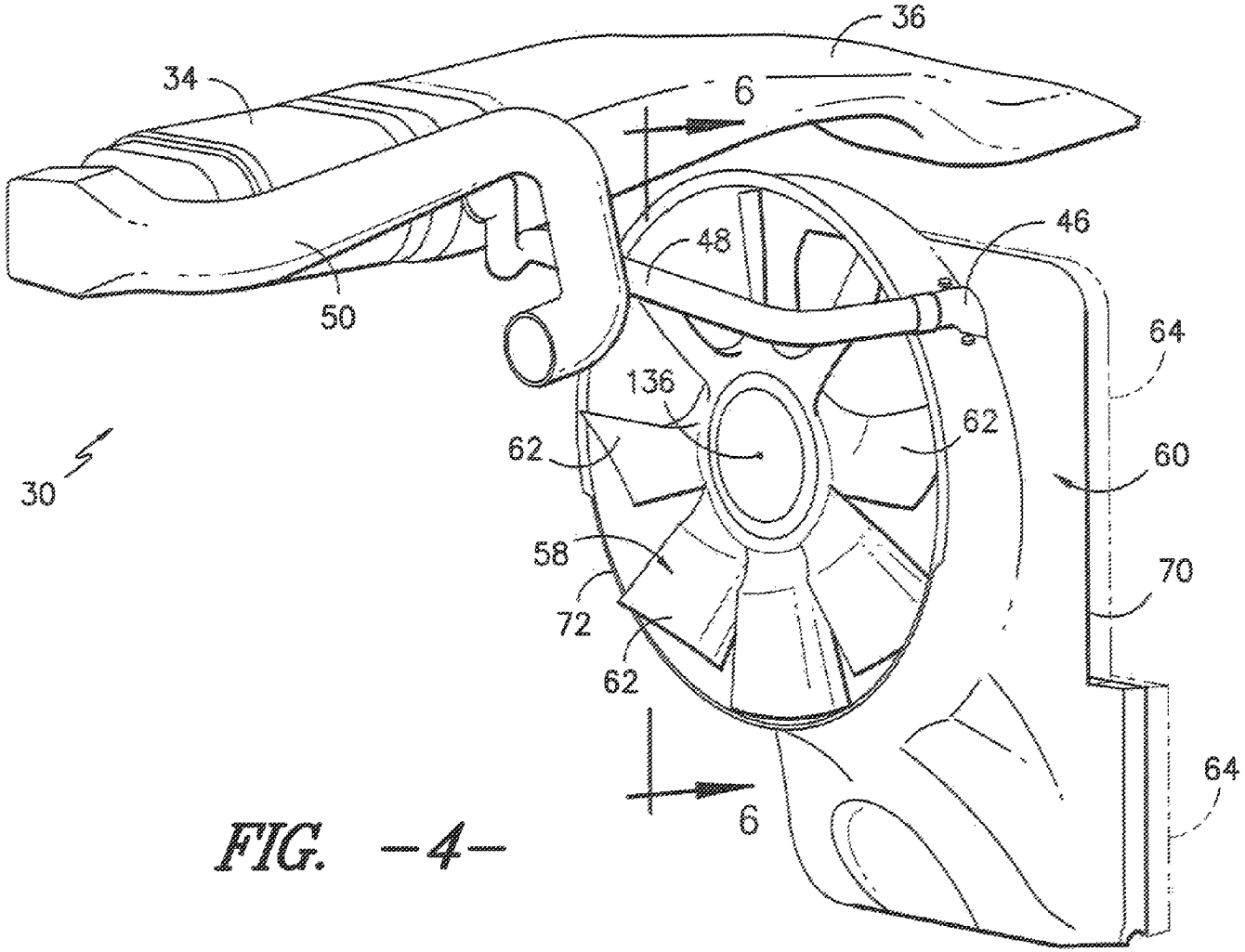
FIG. 4 illustrates a rear perspective view of the components of the air intake system shown in FIG. 2.
Figure 5:
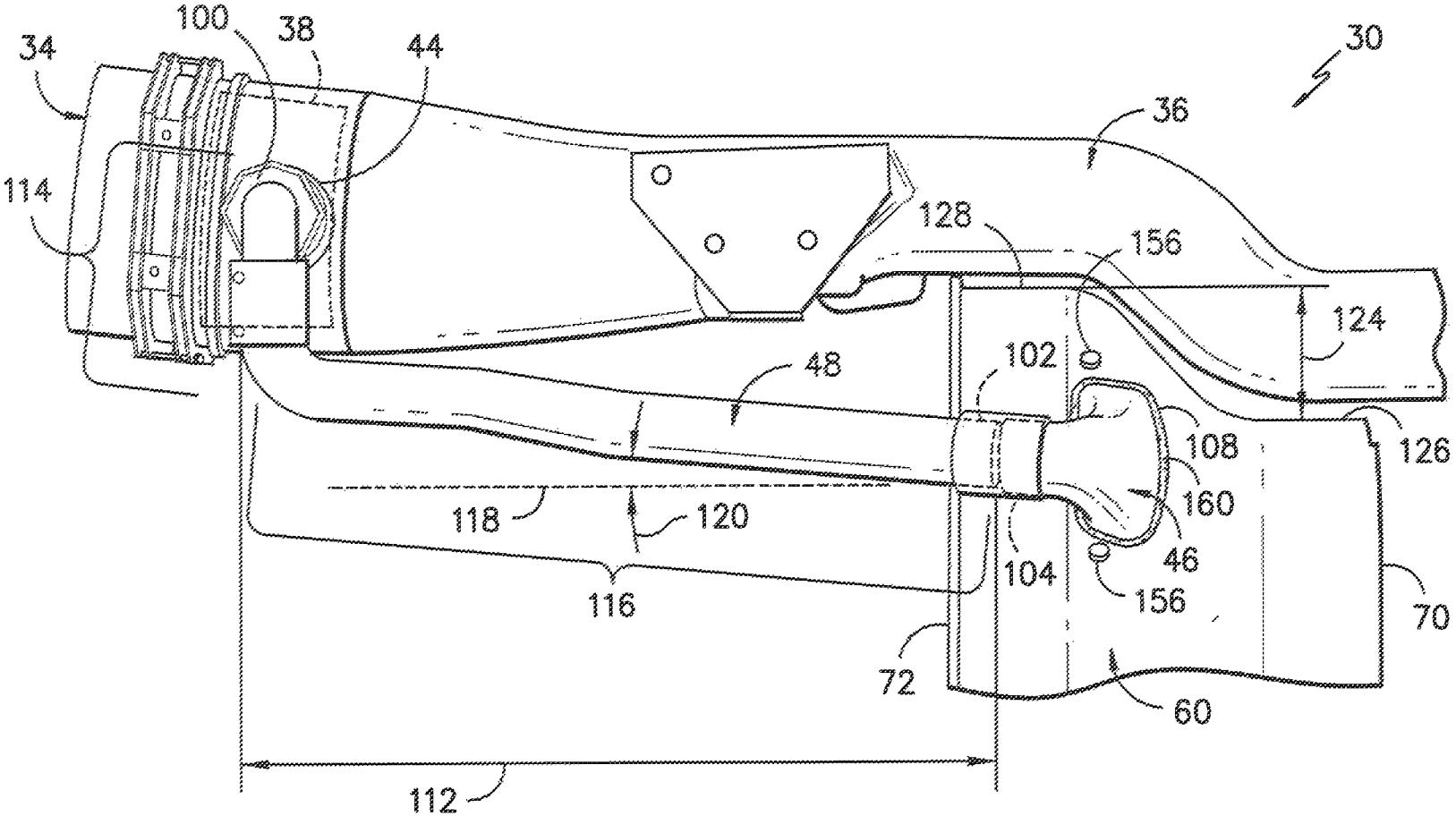
FIG. 5 illustrates a partial side view of the air intake system shown in FIG. 4, particularly illustrating an aspiration conduit of the system extending between a pre-cleaner and an aspiration scoop of the system.
Figure 6:
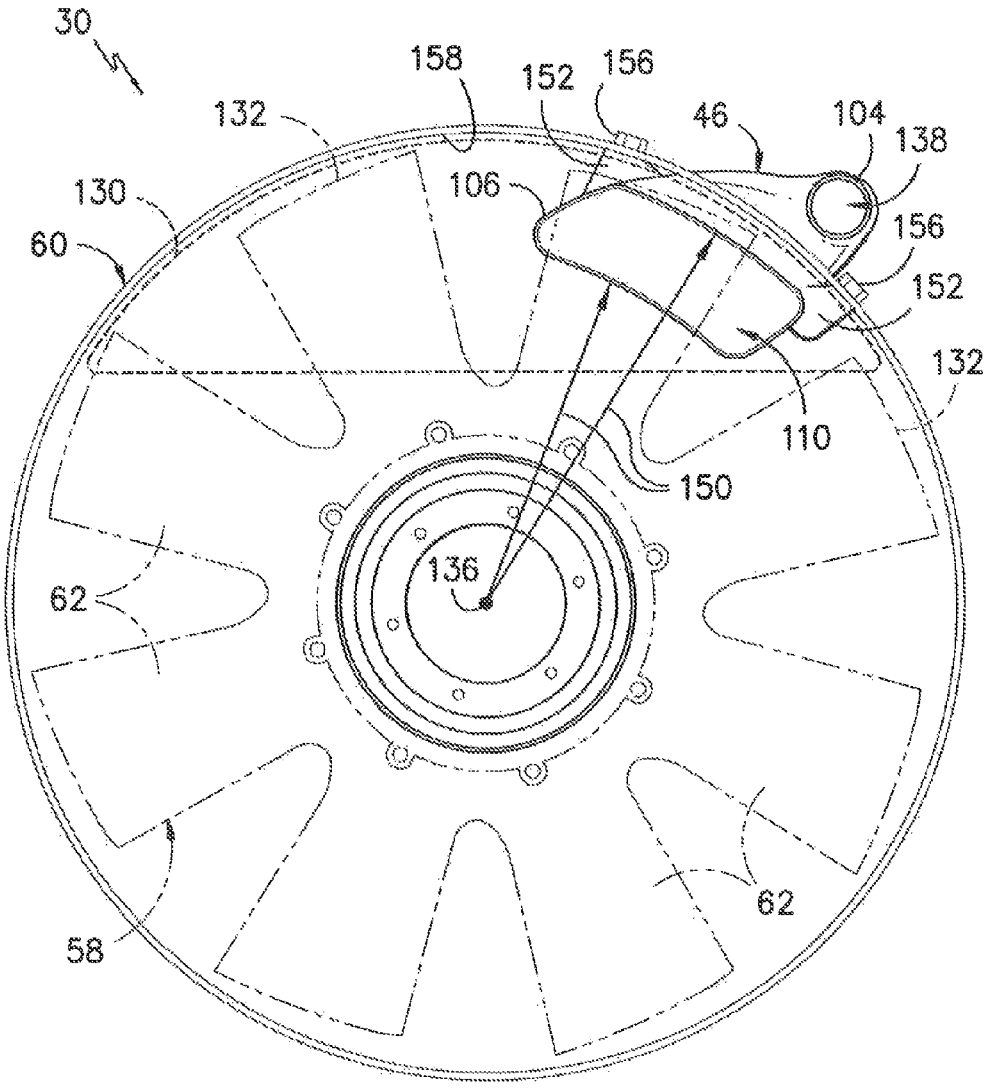
FIG. 6 illustrates a rear view of a fan and an aspiration scoop of the air intake system from a perspective of line 6-6 shown in FIG. 4, particularly illustrating the relative positioning of the fan and aspiration scoop within a fan shroud of the air intake system.
Figure 7:
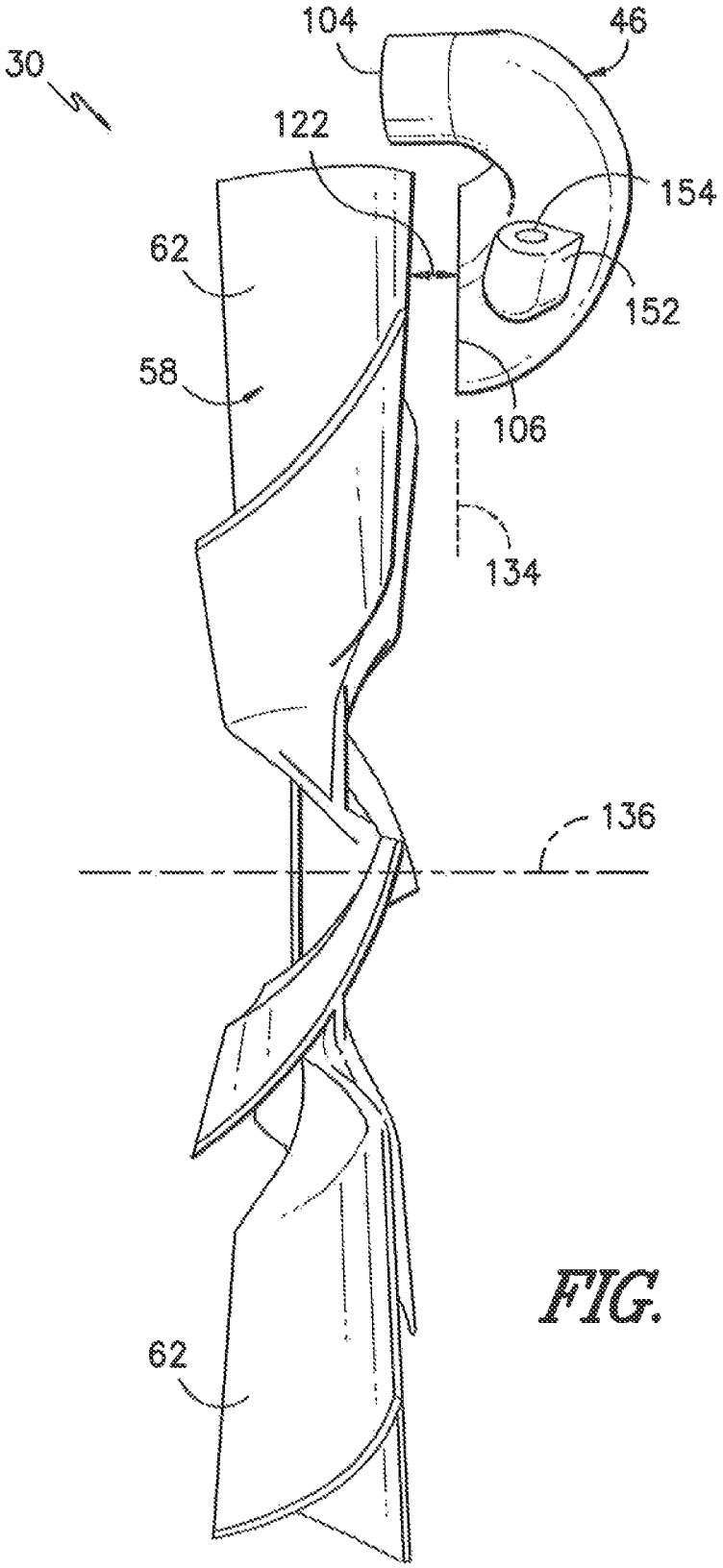
FIG. 7 illustrates a side view of the fan and the aspiration scoop shown in FIG. 6.
Figure 8:
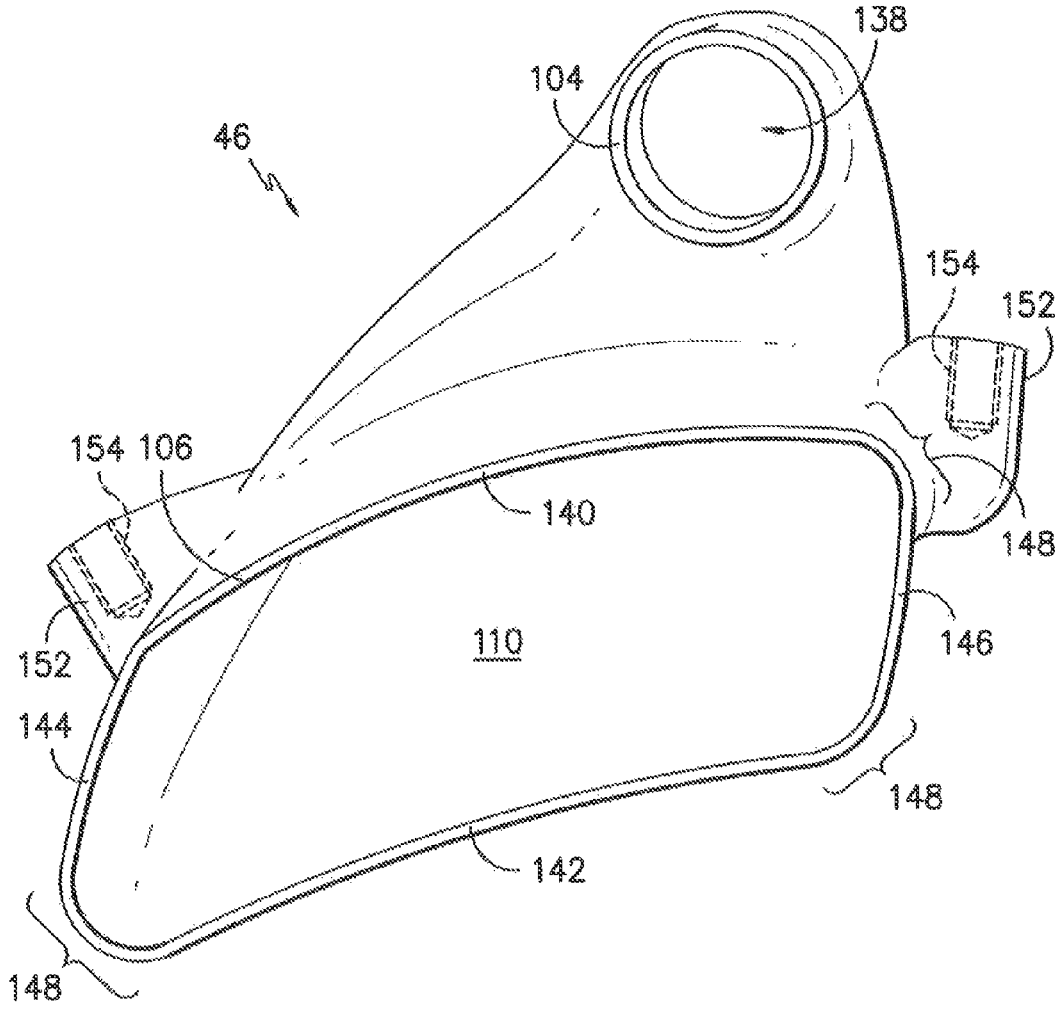
FIG. 8 illustrates a rear view of the aspiration scoop shown in FIGS. 6 and 7.

Referring now to FIGS. 4-8, various components of the air intake system 30 described above are illustrated in accordance with aspects of the present subject matter. Specifically, FIG. 4 illustrates a rear perspective view of the filter assembly 34, intake duct 36, aspiration scoop 46, aspiration conduit 48, output conduit 50, fan 58 and fan shroud 60 of the air intake system 30. FIG. 5 illustrates a side view of a portion of the components shown in FIG. 4, particularly illustrating a side view of the aspiration conduit 48 extending between the filter assembly 32 and the aspiration scoop 46. FIGS. 6 and 7 illustrate respective rear and side views showing the relative positioning of the fan 58 and the aspiration scoop 46 within the fan shroud 60. Additionally, FIG. 8 illustrates a rear view of the aspiration scoop 46.

As indicated above, the air intake system 30 may include both an aspiration conduit 48 and an aspiration scoop 46 for removing the large particulates separated from the engine intake air within the pre-cleaner 38. As particularly shown in FIG. 5, the aspiration conduit 48 may generally be configured to extend between a first end 100 and a second end 102, with the first end 100 being coupled to the scavenge port 44 such that the conduit 48 is in flow communication with the pre-cleaner 38 of the filter assembly 34. Additionally, the aspiration scoop 46 may generally be configured to extend between an inlet end 104 coupled to the second end 102 of the aspiration conduit 48 and an outlet end 106 positioned within the fan shroud 60. For example, as shown in FIGS. 5 and 6, a portion of the aspiration scoop 46 may be configured to extend through a scoop opening 108 (FIG. 5) defined in the fan shroud 60 such that the outlet end 106 of the scoop 46 is positioned within the shroud 60 upstream of the fan 58. Such positioning of the outlet end 106 of the aspiration scoop 46 may generally allow for the pre-cleaner 38 to be aspirated via a fan-generated vacuum. Specifically, as shown in FIG. 6, an outlet opening 110 may be defined at the outlet end 106 of the aspiration scoop 46 that faces in the direction of the fan 58. Thus, when the fan 58 is rotated, a negative pressure may be generated upstream of the fan 58 that causes a vacuum to be applied through the aspiration scoop 46 to suck large particulates out of the pre-cleaner 38 via the scavenge port 44. The particulates may then be directed through the aspiration conduit 48 and subsequently expelled from the aspiration scoop 46 via the outlet opening 110.

As particularly shown in FIG. 5, due to the relative positioning of the filter assembly 34 and the fan shroud 60, the aspiration conduit 48 may be configured to extend a given axial distance 112 between its first and second ends 100, 102. For example, in several embodiments, the filter assembly 34 may be positioned directly above the engine 20 while the fan shroud 60 may be positioned in front of the engine 20 (e.g., as shown in FIG. 2). As a result, the particulates removed from the pre-cleaner 38 may be required to travel a substantial distance 112 within the aspiration conduit 48 prior to being directed into the aspiration scoop 46. Thus, in a particular embodiment of the present subject, the aspiration conduit 48 may be configured to be continuously downwardly sloped across the entire axial distance 112 defined between its first and second ends 100, 102, thereby decreasing the likelihood that any particulates become trapped or stuck within the conduit 48.

For example, as shown in FIG. 5, the aspiration conduit 48 may include a first section 114 extending downward from the scavenge port 44 and a second section 116 extending between the first section 114 and the aspiration scoop 46. In such an embodiment, each section 114, 116 of the aspiration conduit 48 may be configured to have a vertical or downwardly sloped orientation to assist in transferring particulates from the scavenge port 44 to the aspiration scoop 46. For example, as shown in FIG. 5, the first section 114 has a substantially vertical orientation, such as by defining a 90 degree slope angle relative to a reference horizontal plane 118. Similarly, the second section 116 of the aspiration conduit 48 may be configured to be continuously downwardly sloped between the first section 114 and the aspiration scoop 46 such that a non-zero slope angle 120 is defined by the second section 116 relative to the horizontal reference plane 118.

It should be appreciated that the slope angle defined by the aspiration conduit 48 at any axial location between its first and ends 114, 116 may generally correspond to any suitable downwardly sloped, non-zero angle (relative to the horizontal reference plane 118). For instance, as indicated above, the first section 114 may generally define a 90 degree slope angle whereas the second section 116 may define a relatively small slope angle 120, such as an angle ranging from about 1 degree to about 10 degrees or from about 1 degree to about 5 degrees or from about 2 degrees to about 4 degrees and any other subranges therebetween.

As indicated above, a portion of the aspiration scoop 46 may be configured to extend through the fan shroud 60 such that the outlet end 106 of the scoop 56 is positioned within the shroud 60 upstream of the fan 58. In doing so, the outlet end 106 may generally be configured to be positioned at any suitable upstream location relative to the fan 58 that allows for a vacuum to be applied through the scoop 46 when the fan 58 is rotated. For instance, as shown in FIG. 7, the outlet end 106 may be configured to be spaced axially upstream of the fan 58 such that an axial gap 122 is defined between the outlet end 106 and the fan 58. In such an embodiment, it may be desirable to minimize such axial spacing in order to increases the vacuum applied through the scoop 46. For example, the outlet end 106 may be positioned directly adjacent to the fan 58 so that the gap 122 corresponds to a relative short axial distance, such as a distance equal to less than about 50 millimeters or less than about 25 millimeters or less than about 10 millimeters or less than about 5 millimeters.

In addition, the outlet end 106 of the aspiration scoop 46 may generally be configured to be positioned at any suitable circumferential location within the fan shroud 60. However, in several embodiments, the circumferential positioning of the outlet end 106 may be selected so as to minimize the impact of the airflow through the fan shroud 60. For instance, as shown in FIG. 5, the fan shroud 60 is configured to extend upwardly as the shroud 60 transitions from a generally rectangular shape at its inlet 70 to a generally circular shape at its outlet 72 such that a given amount of vertical spacing 124 is defined between an upper surface 126 of the rectangular-shaped portion and an upper surface 128 of the circular-shaped portion. This vertical spacing 124 generally creates a low-flow region within an upper circumferential section of the fan shroud 60 (indicated by dashed box 130 in FIG. 6). In such an embodiment, it may be desirable for the portion of the aspiration scoop 46 extending within the fan shroud 60 to be entirely or at least partially contained within this low-flow region 130, thereby providing for less flow restriction to the air flowing within the high-flow region of the fan shroud 60 (e.g., the region defined below the low-flow region 130).

Moreover, in several embodiments, the aspiration scoop 46 may be configured to extend radially within the fan shroud 60 such that at least a portion of the outlet opening 110 is positioned radially inwardly relative to an outer edge 132 of the fan 58 (i.e., the outer perimeter of the fan 58 defined by the radially outer edges of the fan blades 62 as the fan 58 is rotated). For instance, as shown in FIG. 6, the entire outlet opening 110 may be configured to be positioned radially inwardly from the outer edge 132 of the fan 58. Additionally, in one embodiment, the outlet opening 110 may be configured to be substantially radially oriented within the fan shroud 60. For example, as shown in FIG. 7, a reference plane 134 defined by the outlet opening 110 may be configured to extend substantially perpendicularly relative to a rotational axis 136 of the fan 58.

Referring particularly now to FIG. 8, in several embodiments, the specific configuration of the aspiration scoop 46 may be selected so as to maximize or otherwise enhance the vacuum applied through the scoop 46 when fan 58 is being rotated. For example, in several embodiments, the aspiration scoop 46 may be configured to flare outwardly such that a cross-sectional area of the scoop 46 increases as it extends from its inlet end 104 to its outlet end 106. For instance, in a particular embodiment, the aspiration scoop 46 may be flared outwardly such that the cross-sectional area of the outlet opening 110 is at least 100% larger than the cross-sectional area of an inlet opening 138 defined at the inlet end 104 of the scoop 46, such as by configuring the cross-sectional area of the outlet opening 110 to be at least 200% or at least 300% or at least 400% larger than the cross-sectional area of the inlet opening 138.

Additionally, in several embodiments, the shape of the outlet opening 110 may be specifically tailored to provide for maximum vacuum generation within the aspiration scoop 46. For example, as shown in FIG, 8, the outlet opening 110 may be defined by a top wall 140, a bottom wall 142, and first and second sidewalls 144, 146 extending between the top and bottom walls 140, 142. In one embodiment, one or more of such walls 140, 142, 144, 146 may be configured to be arced or curved such that the outlet opening 110 defines a curved profile around at least a portion of its perimeter. For example, as particularly shown in FIG. 8, both the top and bottom walls 140, 142 define curved profiles extending between the first and second sidewalls 144, 146. In addition, curved transition sections 146 may be defined at one or more of the corners along which the curved top and bottom walls 140, 142 transition into the substantially straight sections of the first and second sidewalls 144, 146. It has been found that such a curved or arcuate inlet opening 110 may allow for improved vacuum generation as opposed to an inlet opening defined by straight sidewalls extending around its entire perimeter.

It should be appreciated that, in several embodiments, the radius of curvature of the top wall 140 and/or the bottom wall 142 may be selected such that the wall(s) 140, 142 extend circumferentially along the same or a similar path as a corresponding radial portion of each fan blade 62 as the fan 58 is rotated. For example, as shown in FIG. 6, in one embodiment, at least a portion of the top wall 140 and/or the bottom wall 142 may define a radius of curvature 150 that is centered at the rotational axis 136 of the fan 58. Such curvature may generally allow for the outlet opening 110 to be circumferentially and radially aligned with the portion of the fan's upstream pressure profile within which the largest negative pressure exists, thereby maximizing the vacuum applied through the aspiration scoop 46.

It should be appreciated that, in several embodiments, the aspiration scoop 46 may be configured to be coupled to a portion of the fan shroud 60. For example, as shown in FIG. 8, the aspiration scoop 46 may include one or more mounting flanges 152, with each mounting flange 152 defining a fastener opening 154 for receiving a suitable mechanical fastener 156 (e.g., a bolt, screw, pin and/or the like). As particularly shown in FIG. 6, each mounting flange 152 may be configured to be positioned directly adjacent to an inner surface 158 of the fan shroud 60, such as by configuring each flange 152 to define a curved mounting surface generally corresponding to the curvature of the fan shroud 60. Thus, when the aspiration scoop 46 is properly positioned relative to the fan shroud 60, suitable fasteners 156 may be inserted through corresponding openings (not shown) defined in the fan shroud 60 and subsequently coupled within the fastener openings 154 to allow the aspiration scoop 46 to be mounted to the fan shroud 60. However, in other embodiments, the aspiration scoop 46 may be configured to be coupled to the fan shroud 60 using any other suitable attachment means.

It should also be appreciated that any gaps defined between the aspiration scoop 46 and the fan shroud 60 may be sealed to prevent air from flowing out of the shroud 60 via the gaps. For example, as shown in FIG. 5, a suitable sealant 160 may be positioned around the inner perimeter of the scoop opening 108 to seal the gap(s) defined between the aspiration scoop 46 and the fan shroud 60.

Figure 9:
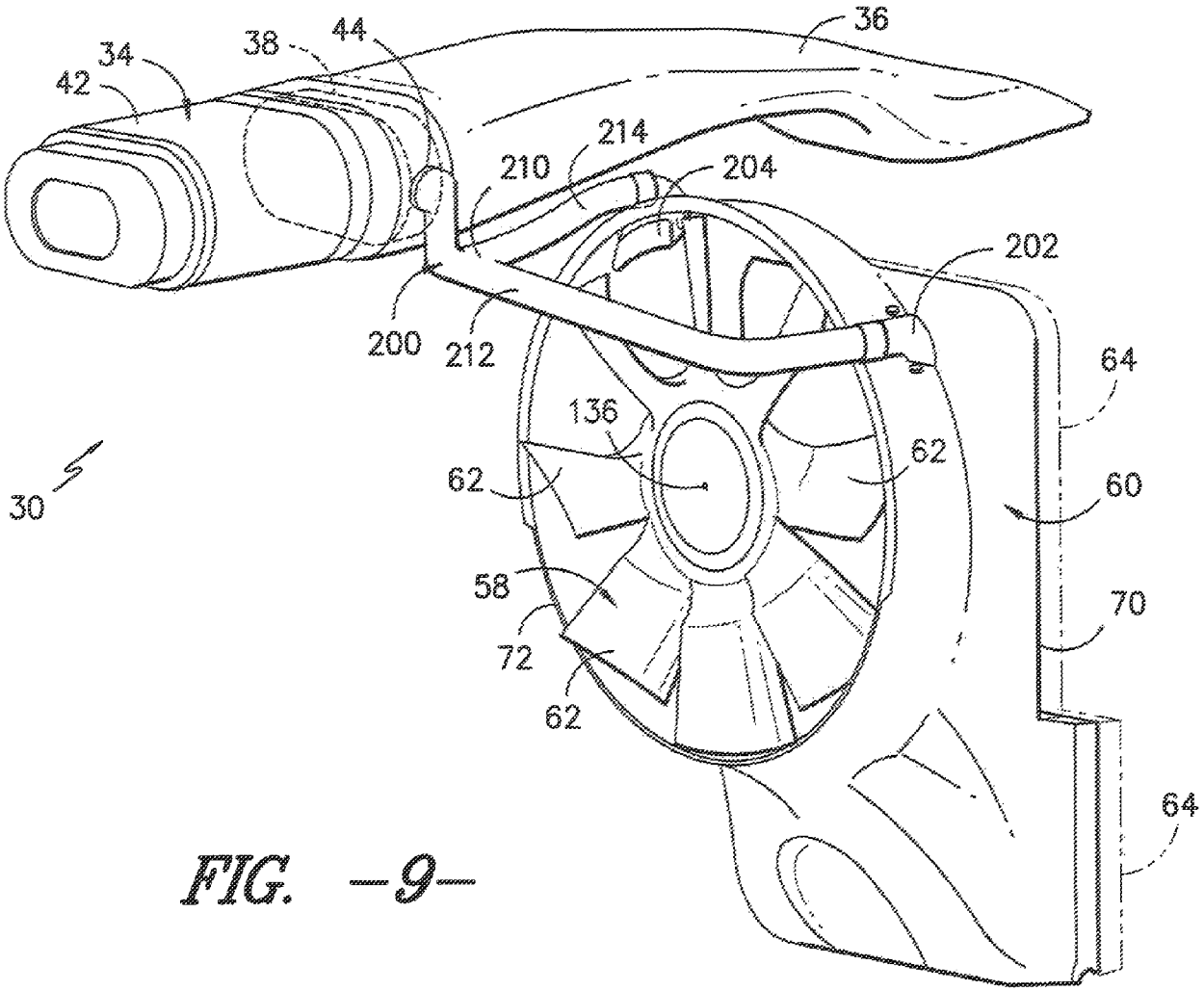
FIG. 9 illustrates another embodiment of the air intake system shown in FIG. 4 with an output conduit of the system removed for purposes of illustration, particularly illustrating the system including a forked aspiration conduit extending between a pre-cleaner and first and second aspiration conduits of the system.

Referring now to FIGS. 9 and 10, an alternative embodiment of the air intake system 30 shown in FIGS. 2-8 is illustrated in accordance with aspects of the present subject matter, particularly illustrating an alternative configuration for aspirating the pre-cleaner 38 of the filter assembly 24. As shown in FIG. 9, similar to the embodiment described above, the air intake system 30 may include an aspiration conduit 200 configured to be in flow communication with the pre-cleaner 38 via the scavenge port 44. However, unlike the embodiment described above, the aspiration conduit 200 may be coupled to multiple aspiration scoops 202, 204 configured to be positioned within the fan shroud 60. For example, as shown in the illustrated embodiment, the air intake system 30 includes first and second aspiration scoops 202, 204 extending through the fan shroud 60 such that an outlet end 106 of each scoop 202, 204 is positioned within the shroud 60 directly upstream of the fan 58. By utilizing multiple aspiration scoops 202, 204, the vacuum applied through the aspiration conduit 200 at the scavenge port 44 may be increased significantly, thereby enhancing the effectiveness of the system 30 in removing particulates from the pre-cleaner 38.

It should be appreciated that the first and second aspiration scoops 202, 204 may generally be configured the same as or similar to the aspiration scoop 46 described above with reference to FIGS. 2-8 (as indicated by the use of the same reference characters). For example, as shown in FIG. 10, each aspiration scoop 202, 204 may define an outlet opening 110 at its outlet end 106 that faces towards the fan 58. As indicated above, the shape of such outlet opening 110 may be specifically tailored to provide for optimal aspiration of the pre-cleaner 38 (e.g., by configuring one or more of the walls defining each outlet opening 110 to have a curved profile). Moreover, as described above, the axial, radial and/or circumferential positioning of each aspiration scoop 202, 204 within the fan shroud 60 may be selected so as to maximize the vacuum applied through the aspiration conduit 200 via the aspiration scoops 202, 204.

Additionally, in embodiments in which the air intake system 30 includes two or more aspiration scoops 202, 204, the aspiration conduit 200 may be split or forked such that each scoop 202, 204 is in flow communication with the scavenge port 44 of the filter assembly 34 via a common conduit. For instance, as particularly shown in FIG. 9, the aspiration conduit 200 may be configured to be forked at a given location 210 downstream of the scavenge port 44 such that a first portion 212 of the conduit 200 extends from the forked location 210 to the first aspiration scoop 202 and a second portion 212 of the conduit 200 extends from the forked location 210 to the second aspiration scoop 204. Alternatively, the air intake system 30 may be configured such that each aspiration scoop 202, 204 is coupled to a separate aspiration conduit. For instance, in one embodiment, the pre-cleaner 38 may be configured to include two scavenge ports, with each scavenge port being in flow communication with one of the aspiration scoops 202, 204 via a separate aspiration conduit.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An air intake system for a work vehicle, the air intake system comprising:

a fan shroud extending between a shroud inlet and a shroud outlet;

a fan disposed within the fan shroud between the shroud inlet and the shroud outlet, the fan being configured to draw air through a front grille of the work vehicle;

an intake duct for receiving a portion of the air drawn through the front grille by the fan;

a filter assembly in flow communication with the intake duct, the filter assembly including a pre-cleaner and an air filter, the pre-cleaner defining a scavenge port;

an aspiration conduit coupled to the scavenge port; and an aspiration scoop extending between an inlet end and an outlet end, the inlet end being coupled to the aspiration conduit, the aspiration scoop extending through a portion of the fan shroud between the inlet and outlet ends such that the outlet end is positioned within the fan shroud at a location upstream of the fan, the outlet end including an outlet opening facing towards the fan, the outlet opening being defined by at least one curved wall, wherein rotation of the fan generates a vacuum within the aspiration scoop such that particulates within the pre-cleaner are directed through the aspiration conduit and are expelled from the outlet opening of the aspiration scoop.

2. The air intake system of claim 1, wherein the outlet opening is defined by a top wall, a bottom wall and first and second sidewalls extending between the top and bottom walls, the top wall and the bottom wall each defining an at least partially curved profile.

3. The air intake system of claim 2, wherein a radius of curvature of at least one of the top wall or the bottom wall is centered at a rotational axis of the fan.

4. The air intake system of claim 1, wherein an axial gap is defined between the fan and the outlet end of the aspiration scoop, the axial distance being equal to less than about 50 millimeters.

5. The air intake system of claim 1, wherein the outlet end of the aspiration scoop is positioned within the fan shroud such that the entire outlet opening is disposed radially inwardly from an outer edge of the fan.

6. The air intake system of claim 1, wherein the outlet opening is positioned at least partially within a low-flow region of the fan shroud.

7. The air intake system of claim 1, wherein a plane defined by the outlet opening is oriented substantially perpendicularly to a rotational axis of the fan.

8. The air intake system of claim 1, wherein the aspiration scoop defines at least one mounting flange configured to extend adjacent to an inner surface of the fan shroud, the at least one mounting flange defining a fastener opening for receiving a mechanical fastener.

9. The air intake system of claim 1, wherein the aspiration conduit extends between a first end coupled to the scavenge port and a second end coupled to the inlet end of the aspiration scoop, the aspiration conduit being continuously downwardly sloped between the first end and the second end.

10. The air intake system of claim 9, wherein the aspiration conduit defines a downward slope angle of at least 1 degree between the first end and the second end.

11. An air intake system for a work vehicle, the air intake system comprising:

a fan shroud extending between a shroud inlet and a shroud outlet;

a fan disposed within the fan shroud between the shroud inlet and the shroud outlet, the fan being configured to draw air through a front grille of the work vehicle;

an intake duct for receiving a portion of the air drawn through the front grille by the fan;

a filter assembly in flow communication with the intake duct, the filter assembly including a pre-cleaner and an air filter, the pre-cleaner defining a scavenge port;

an aspiration conduit extending axially between a first end and a second end, the first end being coupled to the scavenge port, the aspiration conduit being continuously downwardly sloped between the first end and the second end; and an aspiration scoop extending between an inlet end and an outlet end, the inlet end being coupled to the second end of the aspiration conduit, the aspiration scoop extending through a portion of the fan shroud between the inlet and outlet ends such that the outlet end is positioned within the fan shroud at a location upstream of the fan, the outlet end including an outlet opening facing towards the fan, wherein rotation of the fan generates a vacuum within the aspiration scoop such that particulates within the pre-cleaner are directed through the aspiration conduit and are expelled from the outlet opening of the aspiration scoop.

12. The air intake system of claim 11, wherein the aspiration conduit defines a downward slope angle of at least 1 degree between the first and second ends.

13. The air intake system of claim 11, wherein the outlet opening is defined by a top wall, a bottom wall and first and second sidewalls extending between the top and bottom walls, the top wall and the bottom wall each defining a curved profile.

14. The air intake system of claim 13, wherein a radius of curvature of at least one of the top wall or the bottom wall is centered at a rotational axis of the fan.

15. The air intake system of claim 11, wherein an axial gap is defined between the fan and the outlet end of the aspiration scoop, the axial distance being equal to less than about 50 millimeters.

16. The air intake system of claim 11, wherein the outlet end of the aspiration scoop is positioned within the fan shroud such that the entire outlet opening is disposed radially inwardly from an outer edge of the fan.

17. The air intake system of claim 11, wherein the outlet opening is positioned at least partially within a low-flow region of the fan shroud.

18. The air intake system of claim 11, wherein a plane defined by the outlet opening is oriented substantially perpendicularly to a rotational axis of the fan.

19. An air intake system for a work vehicle, the air intake system comprising:

a fan shroud extending between a shroud inlet and a shroud outlet;

a fan disposed within the fan shroud between the shroud inlet and the shroud outlet, the fan being configured to draw air through a front grille of the work vehicle;

an intake duct for receiving a portion of the air drawn through the front grille by the fan;

a filter assembly in flow communication with the intake duct, the filter assembly including a pre-cleaner and an air filter, the pre-cleaner defining a scavenge port;

an aspiration conduit coupled to the scavenge port; and first and second aspiration scoops, each of the first and second aspiration scoops extending between an inlet end and an outlet end, the inlet end being coupled to the aspiration conduit, each of the first and second aspiration scoops extending through a portion of the fan shroud between the inlet and outlet ends such that the outlet end is positioned within the fan shroud at a location upstream of the fan, the outlet end including an outlet opening facing towards the fan, wherein rotation of the fan generates a vacuum within each of the first and second aspiration scoops such that particulates within the pre-cleaner are directed through the aspiration conduit and are expelled from the outlet opening of each of the first and second aspiration scoops.

20. The air intake system of claim 19, wherein the aspiration conduit is forked at a location downstream of the scavenge port such that a first portion of the aspiration conduit extends to the first aspiration scoop and a second portion of the aspiration conduit extends to the second aspiration scoop.

* * * * *